US006097268A

United States Patent [19]

Watanabe et al.

[11] Patent Number: 6,097,268

[45] **Date of Patent: *Aug. 1, 2000**

[54] MULTILAYER DUPLEXER WITH NO SHIELDING ELECTRODES

[75] Inventors: Takahiro Watanabe, Oumihachiman; Norio Nakajima, Takatsuki; Mitsuhide Kato, Sabae, all of Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/915,894

[22] Filed: Aug. 21, 1997

[30] Foreign Application Priority Data

Aug. 21, 1996 [JP] Japan ..... 8-220023
Jul. 18, 1997 [JP] Japan ..... 9-193970

[51] Int. Cl.[7] ..... H01P 1/213

[52] U.S. Cl. ..... 333/132; 333/134; 333/185

[58] Field of Search ..... 333/128, 129, 333/132, 134, 185

[56] References Cited

FOREIGN PATENT DOCUMENTS 4-103209 4/1992 Japan ..... 333/134
5-327319 12/1993 Japan ..... 333/134
6-85506 3/1994 Japan .

*Primary Examiner*—Justin P. Bettendorf
*Attorney, Agent, or Firm*—Ostrolenk, Faber, Gerb & Soffen, LLP

[57] ABSTRACT

A high-frequency component which requires no shielding electrodes and in which there are no limitations upon the places where plural sets of filter components can be formed. In one embodiment, a high-frequency component has first to third ports, and includes a BPF connected between the first port and the second port and a BRF connected between the first port and the third port. The BPF and BRF comprise transmission lines and capacitors formed on a plurality of laminated dielectric layers. In another embodiment, the component comprises an HPF and an LPF formed on a plurality of dielectric layers. In both cases, the passbands of the respective filters are predetermined not to substantially overlap one another.

6 Claims, 8 Drawing Sheets

MULTILAYER DUPLEXER WITH NO SHIELDING ELECTRODES

BACKGROUND OF THE INVENTION

1. Field of the Invention

The present invention relates to a high-frequency component for use in high-frequency circuits of mobile communications equipment, e.g., portable telephones, for distributing or coupling two high-frequency signals in different frequency ranges.

2. Description of the Related Art

FIG. 9 illustrates a duplexer 50 as one example of a conventional high-frequency component for distributing or coupling high-frequency signals. The duplexer 50 comprises a low pass filter (LPF) 51 and traps 52, 53 each constructed as a parallel resonator. The LPF 51 and the trap 52 cooperatively make up a low-frequency filter. Thus, a signal input to a first port 54 is output from a second port 55 through the trap 52. On the other hand, the trap 53 constitutes a high-frequency filter. Thus, a signal input to a third port 56 is output from the second port 55 through the trap 53.

Because of using discrete components such as the LPF 51 and the traps 52, 53, the duplexer 50 constructed as explained above has however a problem that it has a large size and cannot easily meet current demands in the field of mobile communications equipment, for example, where the device size will presumably be further reduced in the future.

With a view toward solving the above problem, Japanese Unexamined Patent Publication No. 6-85506 discloses a duplexer 60 as shown in FIG. 10. The duplexer 60 is constructed such that a high-frequency filter 61 and a low-frequency filter 62 each comprise a plurality of dielectric layers (not shown in detail) which are stacked and laminated one above another and provided with inductance forming electrodes and capacitance forming electrodes. The filters 61 and 62 are built in a single multilayer substrate 64 with a shielding electrode 63 stacked and laminated in parallel between the respective sets of layers that form the filters 61 and 62.

In the high-frequency component (duplexer) shown in FIG. 10, the shielding electrode must be provided between the high-frequency filter and the low-frequency filter to shield the high-frequency filter and the low-frequency filter from each other for suppressing mutual interference. Since the respective layers and the shielding electrode 63 are all stacked in parallel, it is relatively easy to insert the shielding electrode 63 between the filters 61 and 62 while the multilayer substrate 64 is being manufactured.

On the other hand, it is desirable for the high-frequency filter and the low-frequency filter to be formed side by side horizontally in order to reduce the height of the duplexer. In this case (not shown), a difficulty is encountered in forming the shielding electrode, if each filter is formed by laminating the respective plurality of dielectric layers one above another in the direction of height. Since the shield electrode must be disposed between the first filter and the second filter, the shield electrode must be disposed perpendicularly to the layers that make up the filters. The shield electrode must be accurately inserted between the two filters after they are manufactured, which is very difficult. This problem places a limitation upon the use of a duplexer in which the high-frequency and low-frequency filters are disposed side-by-side.

SUMMARY OF THE INVENTION

A feature of the present invention is to solve the problems as set forth above, and to provide a high-frequency component which requires no shielding electrodes and imposes no limitations upon places where plural sets of filter components can be formed.

To achieve the above object, according to the present invention, a high-frequency component comprises a multilayer substrate formed by laminating a plurality of dielectric layers, and at least two sets of filter components having frequency pass ranges selected not to overlap with each other, the filter components being formed of inductance elements and capacitance elements and being built in the multilayer substrate.

Also, the sets of filter components are made up of strip line electrodes provided on a surface of at least one of the dielectric layers for constituting the inductance elements, capacitor electrodes provided on a surface of at least one of the dielectric layers for constituting the capacitance elements, ground electrodes provided on a surface of at least one of the dielectric layers, and viahole electrodes penetrating the dielectric layers for connection of the strip line electrodes, the capacitor electrodes and the ground electrodes.

Further, a combination of the sets of filter components is any combination of a band pass filter and a band reject filter, a high pass filter and a low pass filter, a band pass filter and a band pass filter, and a band reject filter and a band reject filter.

With the high-frequency component of the present invention, since at least two filter components made up of inductance elements and capacitance elements are selected to have their frequency pass ranges not overlapping with each other, there is no need of providing a shielding electrode.

DESCRIPTION OF EMBODIMENTS OF THE INVENTION

Embodiments of the present invention will be described hereunder with reference to the drawings.

Figure 1:
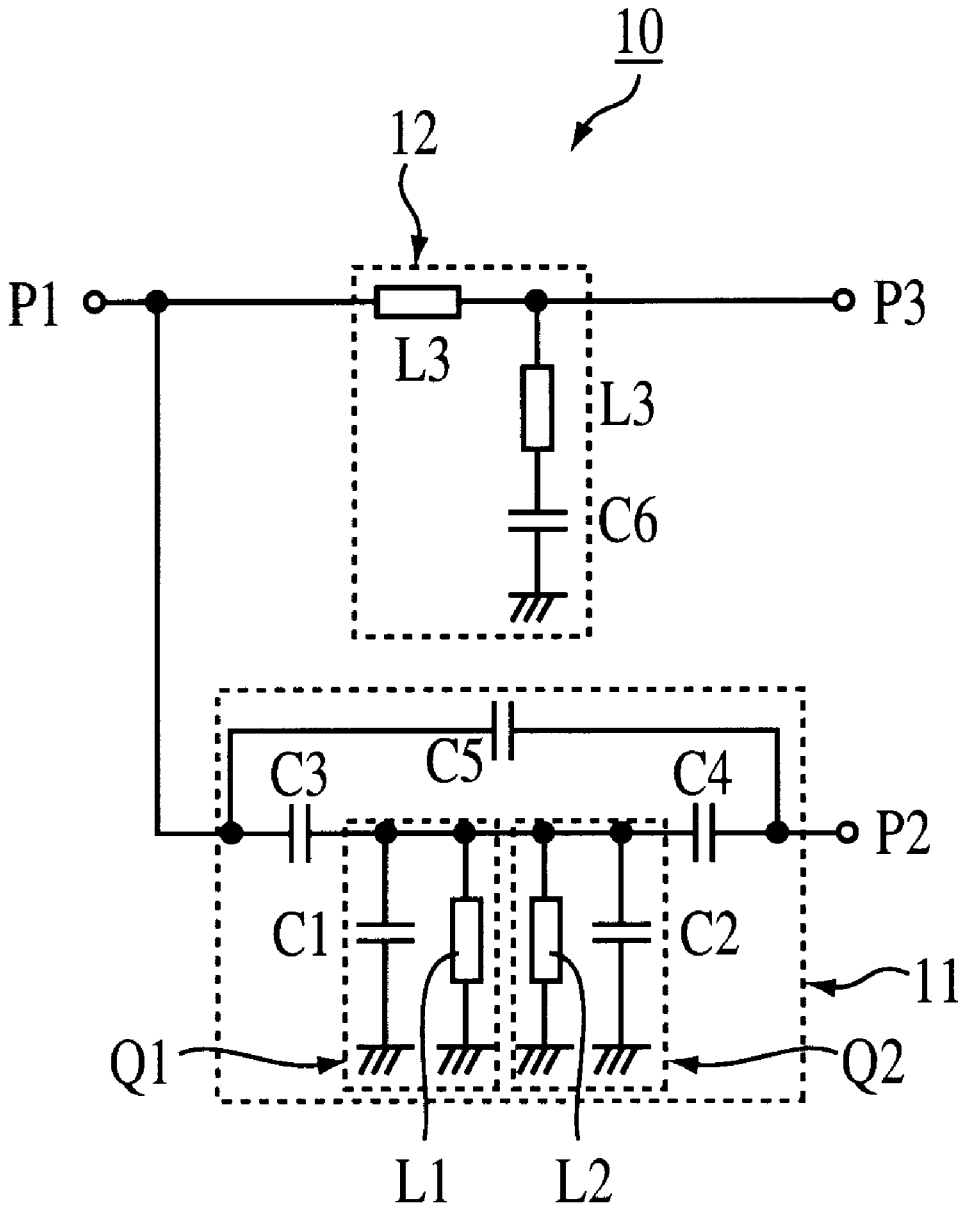
FIG. 1 is a circuit diagram of a first embodiment of a high-frequency component according to the present invention.
Figure 2A:
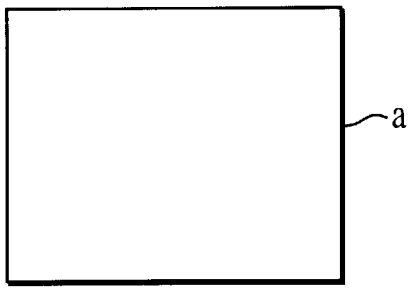
FIGS. 2(*a*) to 2(*h*) are top plan views of first to eighth dielectric layers making up the high-frequency component of FIG. 1.
Figure 2B:
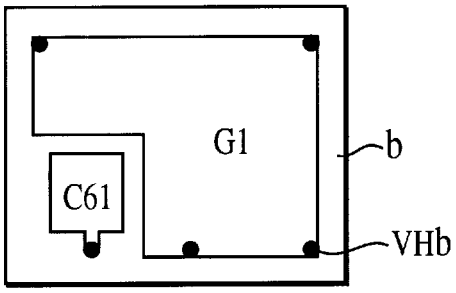
Figure 2C:
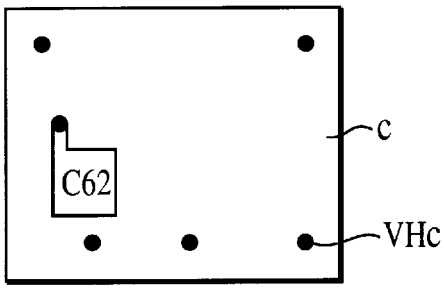
Figure 2D:
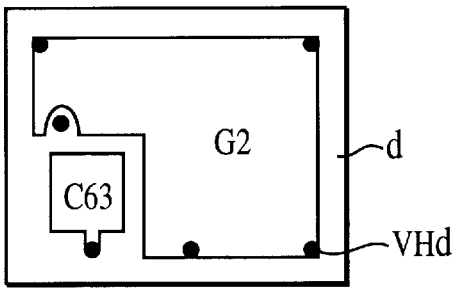
Figure 2E:
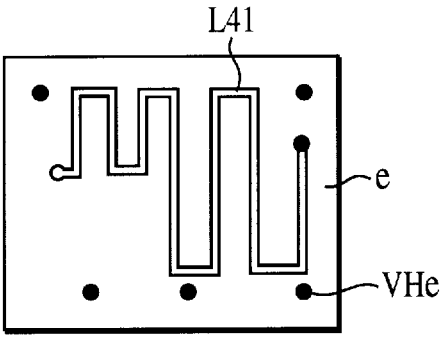
Figure 2F:
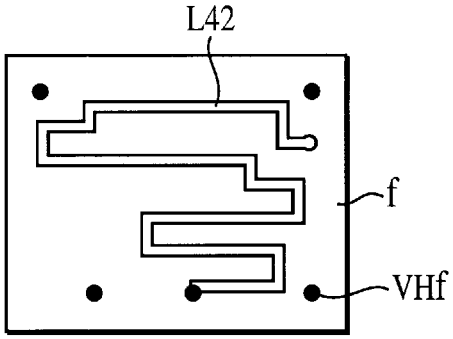
Figure 2G:
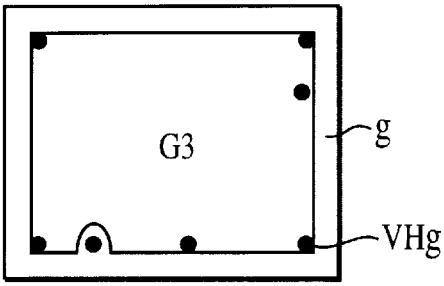
Figure 2H:
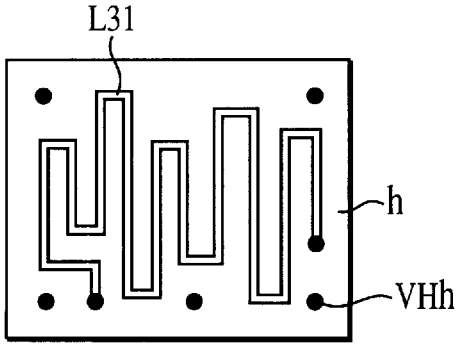
Figure 3A:
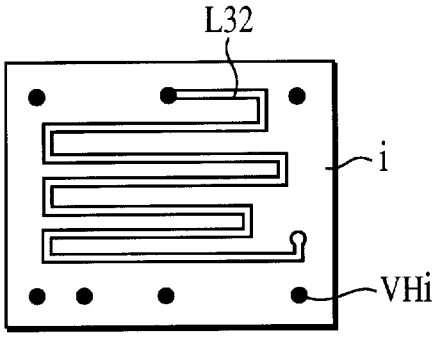
FIGS. 3(*a*) to 3(*h*) are top plan views of ninth to sixteenth dielectric layers making up the high-frequency component of FIG. 1.
Figure 3B:
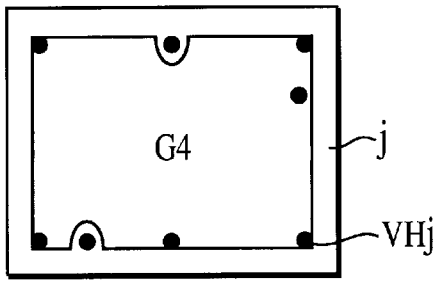
Figure 3C:
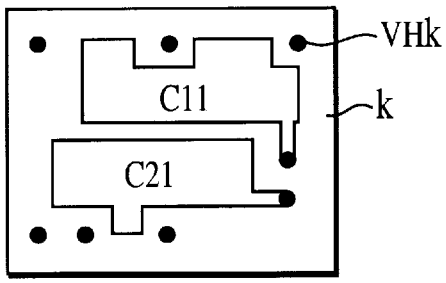
Figure 3D:
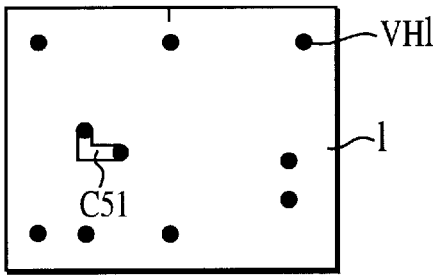
Figure 3E:
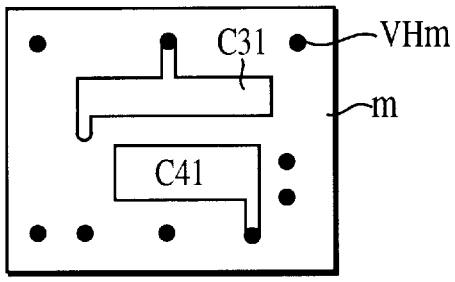
Figure 3F:
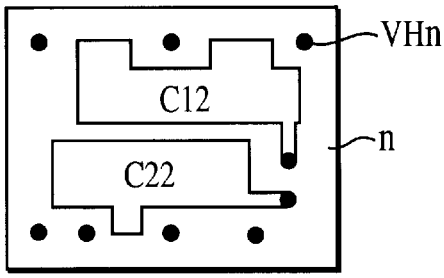
Figure 3G:
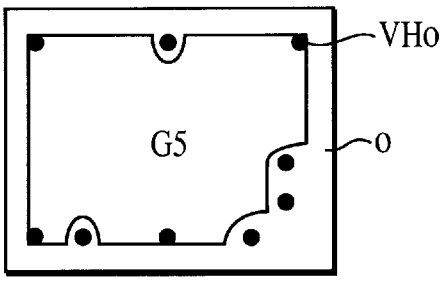
Figure 3H:
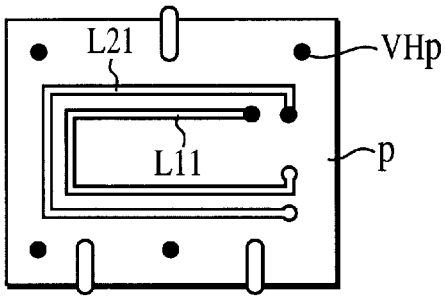

FIG. 1 shows a circuit diagram of a first embodiment of a high-frequency component according to the present invention. A high-frequency component 10 has first to third ports P1–P3, and comprises a band pass filter (BPF) 11 connected between the first port P1 and the second port P2 and a band reject filter (BRF) 12 connected between the first port P1 and the third port P3. The BPF 11 and the BRF 12 are formed of only transmission lines L1–L4 serving as inductance elements and capacitors C1–C6 serving as capacitance elements.

More specifically, the BPF 11 comprises a resonance circuit Q1 formed by parallel connection of the transmission line L1 and the capacitor C1 between the first port P1 and ground, a resonance circuit Q2 formed by parallel connection of the transmission line L2 and the capacitor C2 between the second port P2 and ground, the capacitor C3 connected between the first port P1 and a junction of the transmission line L1 and the capacitor C1, the capacitor C4 connected between the second port P2 and a junction of the transmission line L2 and the capacitor C2, and the capacitor C5 connected between the first port P1 and the second port P2. The transmission line L1 of the resonance circuit Q1 and the transmission line L2 of the resonance circuit Q2 are coupled to each other with a magnetic coupling degree M.

Also, the BRF 12 comprises the transmission line L3 connected between the first port P1 and the third port P3, and the transmission line L4 and the capacitor C6 connected in series between the ground and a junction of the transmission line L3 and the third port P3.

With the above arrangement, only a high-frequency signal in a desired frequency range can pass between the first port P1 and the second port P2, and high-frequency signals in other frequency ranges pass between the first port P1 and the third port P3. In this respect, the frequency pass range of the BPF 11 and the frequency pass ranges of the BRF 12 are selected not to overlap with each other.

When the high-frequency component is used in a TV, for example, of the high-frequency signals input through the first port P1, only the signal in an appropriate channel such as 600 MHz is output to the second port P2 and the remaining signals other than 600 MHz are output to the third port P3.

Figure 4A:
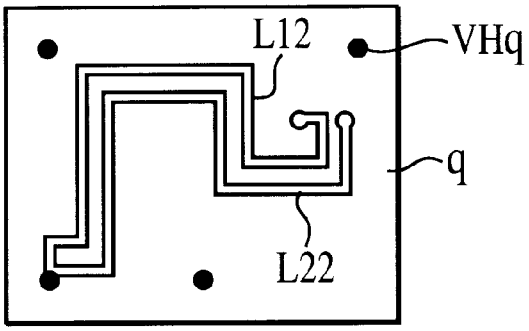
FIGS. 4(*a*) and 4(*b*) are top plan views of seventeenth and eighteenth dielectric layers making up the high-frequency component of FIG. 1, and FIG. 4(*c*) is a bottom plan view of the eighteenth dielectric layer.
Figure 4B:
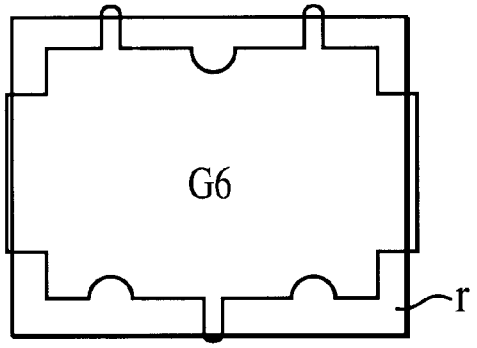
Figure 4C:
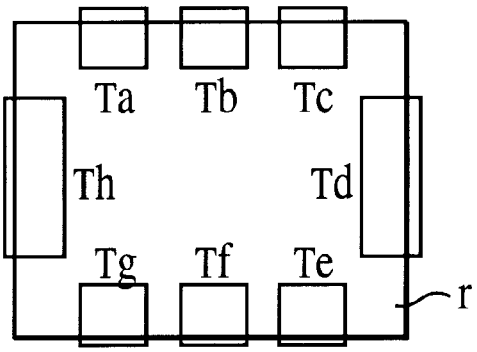

FIGS. 2(*a*) to 2(*h*), FIGS. 3(*a*) to 3(*h*), and FIGS. 4(*a*) to 4(*c*) are top and bottom plan views of respective dielectric layers making up the high-frequency component 10 of FIG. 1. The high-frequency component 10 includes a multilayer substrate (not shown) with the BPF 11 and the BRF 12 built therein. The multilayer substrate is formed by laminating first to nineteenth dielectric layers a–r successively from the top.

Capacitor electrodes C61, C62, C63, C11, C21, C51, C31, C41, C12 and C22 are formed on corresponding upper surfaces of the second, third, fourth, eleventh, twelfth, thirteenth and fourteenth dielectric layers b, c, d, k, l, m and n.

Also, strip line electrodes L41, L42, L31, L32, L21, L11, L12 and L22 are formed on corresponding upper surfaces of the fifth, sixth, eighth, ninth, sixteenth and seventeenth dielectric layers e, f, h, i, p and q. Further, ground electrodes G1–G6 are formed respectively on upper surfaces of the second, fourth, seventh, ninth, fifteenth and nineteenth dielectric layers b, d, g, j, o and r. On a lower surface of the nineteenth dielectric layer r (FIG. 4(*c*)), there are formed external terminals Ta, Tc and Tf connected to the first to third ports, respectively, and ground terminals Tb, Td, Te, Tg and Th.

Moreover, viahole electrodes VHa–VHq are formed respectively in the first to eighteenth dielectric layers a–q so as to penetrate the layers a–q. The capacitor electrodes C11, C12, C21, C22, C31, C41, C51, C61, C62 and C63, the strip line electrodes L11, L12, L21, L22, L31, L32, L41 and L42, and the ground electrodes G1–G6 are appropriately connected through the viahole electrodes VHa–VHq.

In the BPF 11, the appropriate connections, the capacitor electrode and ground electrodes make up the capacitors C1–C5 as follows:

C1: (C11+G4)+(C12+G5)

C2: (C21+G4)+(C22+G5)

C3: (C31+C11)+(C31+C12)

C4: (C41+C21)+(C41+C22)

C5: (C51+C41).

, and the capacitor electrodes C61–C63 make up the capacitor C6 of the BRF 12.

Further, the strip line electrodes L11, L12 make up the transmission line L1 of the BPF 11, the strip line electrodes L21, L22 make up the transmission line L2 of the BPF 11, the strip line electrodes L31, L32 make up the transmission line L3 of the BRF 12, and the strip line electrodes L41, L42 make up the transmission line L4 of the BRF 12.

As a result, the high-frequency component 10 having the circuit shown in FIG. 1 is constructed into a single multilayer substrate.

With the high-frequency component of this first embodiment, as explained above, since the band pass filter connected between the first port and the second port and the band reject filter connected between the first port and the third port are formed of only the transmission lines and the capacitors, all the elements can be built in the multilayer substrate. It is therefore possible to achieve a reduction in size and cost of the high-frequency component. Practically, all the elements can be built in a multilayer substrate having outline dimensions of 5.0 mm(L)×4.0 mm(W)×1.9 mm(H).

Also, since the frequency pass range of the BPF and the frequency pass ranges of the BRF are selected not to overlap with each other, there is no need of providing a shielding electrode between the BPF and the BRF. It is thus possible to suppress interference between the BPF and the BRF and to easily achieve desired characteristics without providing any shielding electrode.

Further, since there is no need of providing a shielding electrode, the BPF and the BRF can be located freely in any desired place in the multilayer substrate without restrictions. For example, the BPF and the BRF can be formed side by side horizontally on the multilayer substrate.

Additionally, the manufacturing process is simplified, since the band pass filter and the band reject filter are made up of the strip line electrodes, capacitor electrodes and ground electrodes which are provided on the surfaces of a plurality of dielectric layers, as well as the viahole electrodes penetrating the respective dielectric layers for the appropriate connection of the strip line electrodes, capacitor electrodes and ground electrodes.

Figure 5:
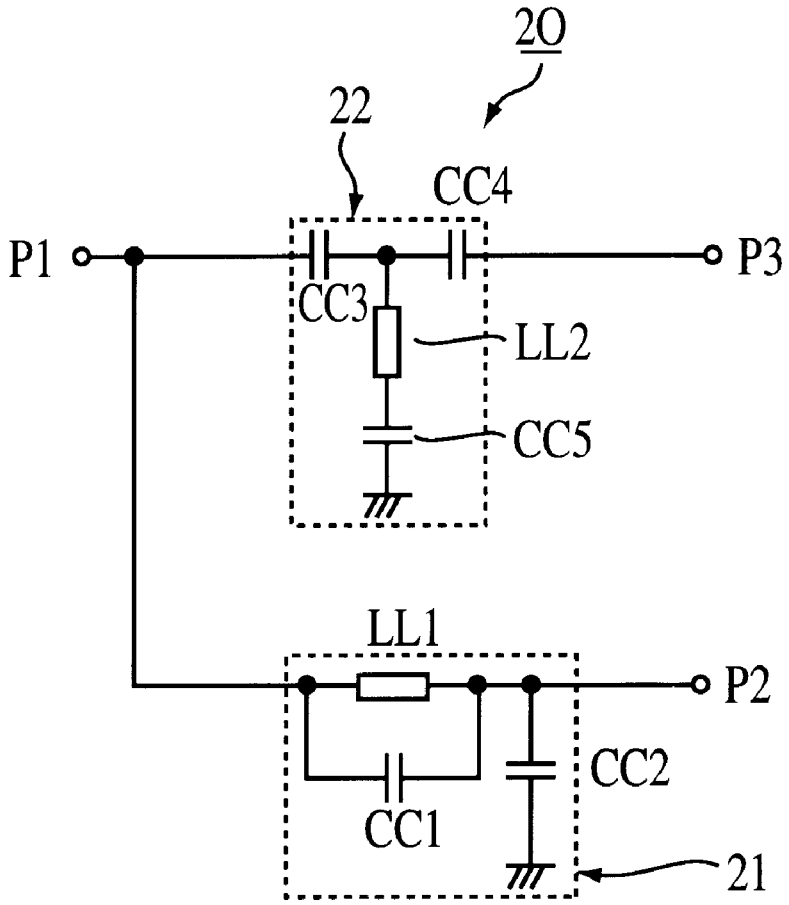
FIG. 5 is a circuit diagram of a second embodiment of the high-frequency component according to the present invention.
Figure 6A:
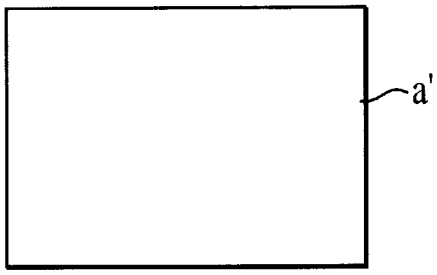
FIGS. 6(*a*) to 6(*h*) are top plan views of first to eighth dielectric layers making up the high-frequency component of FIG. 5.
Figure 6B:
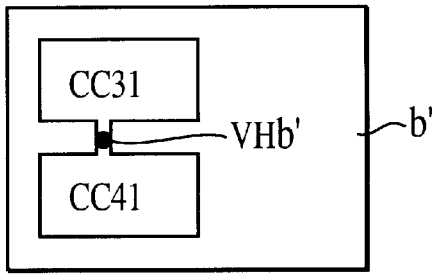
Figure 6C:
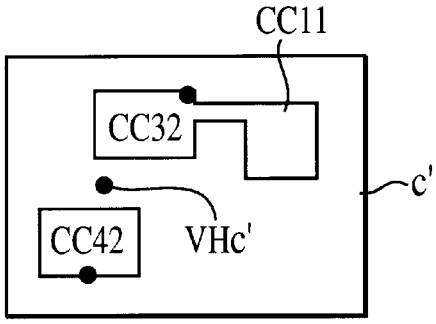
Figure 6D:
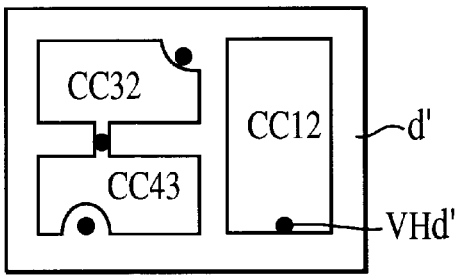
Figure 6E:
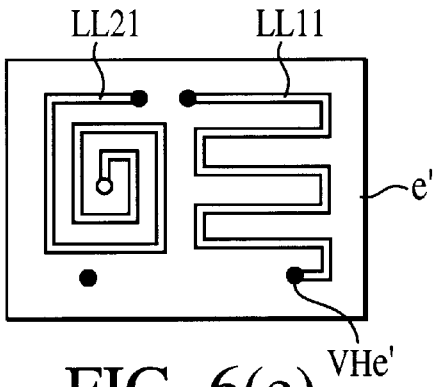
Figure 6F:
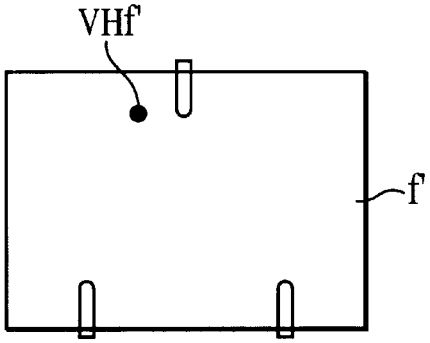
Figure 6G:
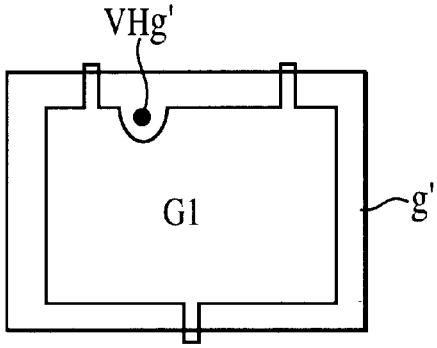
Figure 6H:
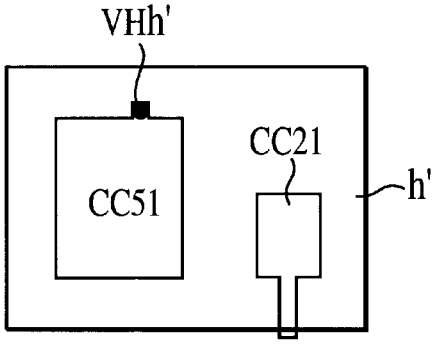

FIG. 5 shows a circuit diagram of a second embodiment of the high-frequency component according to the present invention. A high-frequency component 20 of the second embodiment differs from the high-frequency component 10 of the first embodiment in that a low pass filter (LPF) 21 is connected between the first port P1 and the second port P2, and a high pass filter (HPF) 22 is connected between the first port P1 and the third port P3. The LPF 21 and the HPF 22 are formed of only transmission lines LL1, LL2 serving as inductance elements and capacitors CC1–CC4 serving as capacitance elements.

More specifically, the LPF 21 is constructed such that a parallel circuit comprising the transmission line LL1 and the capacitor CC1 is connected between the first port P1 and the second port P2, and a junction of the transmission line LL1 and the capacitor CC1 is grounded through the capacitor CC2.

Also, the HPF 22 is constructed such that a serial circuit comprising the capacitor CC3 and the capacitor CC4 is connected between the first port P1 and the third port P3, and a junction of the capacitor CC3 and the capacitor CC4 is grounded through a serial circuit comprising the transmission line LL2 and the capacitor CC5.

With the above arrangement, a high-frequency signal in a lower frequency range passes between the first port P1 and the second port P2, and a high-frequency signal in a higher frequency range passes between the first port P1 and the third port P3. In this respect, the frequency pass range of the LPF 21 and the frequency pass range of the HPF 22 are selected not to overlap with each other.

As one example, when the high-frequency component 20 is used in the PDC 800 (Personal Digital Cellular 800) system with an antenna, a reception circuit and a transmission circuit connected respectively to the first port P1, the second port P2 and the third port P3, a reception signal of 820 MHz received by the antenna is output to the reception circuit through the LPF. On the other hand, a transmission signal of 950 MHz output from the transmission circuit is transmitted from the antenna through the HPF.

As another example, when the high-frequency component 20 is used to distribute or couple a plurality of high-frequency signals in different frequency ranges, e.g., high-frequency signals of 800 MHz for the AMPS (Advanced Mobile Phone Service) system and of 1.9 GHz for the PCS (Personal Communication Service) system, with an antenna, transmission/reception circuits for 800 MHz and transmission/reception circuits for 1.9 GHz connected respectively to the first port P1, the second port P2 and the third port P3, a reception signal of 800 MHz received by the antenna is output to the reception circuit for 800 MHz through the LPF and a reception signal of 1.9 GHz received by the antenna is output to the reception circuit for 1.9 GHz through the HPF. On the other hand, a transmission signal output from the transmission circuit for 950 MHz is transmitted from the antenna through the LPF and a transmission signal output from the transmission circuit for 1.9 GHz is transmitted from the antenna through the HPF. In this case, the high-frequency component can be employed as a dual-band high-frequency distributor or coupler. Accordingly, the size of dual-band mobile communications equipment can be made smaller.

Figure 7A:
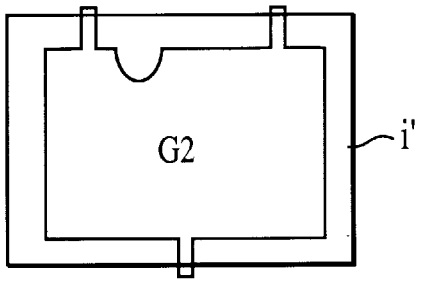
FIG. 7(*a*) is a top plan view of a ninth dielectric layer making up the high-frequency component of FIG. 5, and FIG. 7(*b*) is a bottom plan view of the ninth dielectric layer.
Figure 7B:
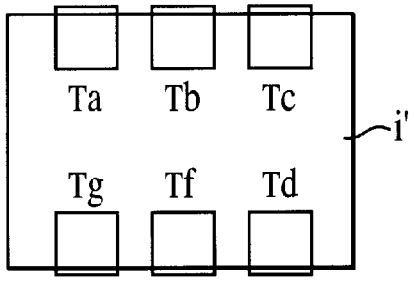

FIGS. 6(*a*) to 6(*h*) and FIGS. 7(*a*) and 7(*b*) are top and bottom plan views of respective dielectric layers making up the high-frequency component 20 of FIG. 5. The high-frequency component 20 includes a multilayer substrate (not shown) with the LPF 21 and the HPF 22 built therein. The multilayer substrate is formed by laminating first to ninth dielectric layers a'–i' successively from the top.

Capacitor electrodes CC31, CC41, CC32, CC42, CC11, CC33, CC43, CC12, CC21 and CC51 are formed on corresponding upper surfaces of the second, third, fourth and eighth dielectric layers b', c', d' and h'. Also, strip line electrodes LL11 and LL21 are formed on an upper surface of the fifth dielectric layer e'.

Further, ground electrodes G1, G2 are formed respectively on upper surfaces of the seventh and ninth dielectric layers g', i'. On a lower surface of the ninth dielectric layer i' (FIG. 7(*b*)), there are formed external terminals Tb, Td and Tg connected to the first to third ports P1–P3, respectively, and ground terminals Ta, Tc and Tf.

Moreover, viahole electrodes VHa'–VHh' are formed respectively in the first to eighth dielectric layers a'–h' so as to penetrate the layers a'–h'. The capacitor electrodes CC11, CC12, CC21, CC31, CC32, CC33, CC41, CC42, CC43 and CC51, the strip line electrodes LL11, LL21, and the ground electrodes G1, G2 are appropriately connected through the viahole electrodes VHa'–VHh'.

Through the appropriate connection, the capacitor electrodes CC11, CC12 make up the capacitor CC1 of the LPF 21, the capacitor electrode CC21 and the ground electrode G2 make up the capacitor CC2 of the LPF 21, the capacitor electrodes CC31–CC33 make up the capacitor CC3 of the HPF 22, the capacitor electrodes CC41–CC43 make up the capacitor CC4 of the HPF 22, and the capacitor electrode CC51 and the ground electrode G2 make up the capacitor CC5 of the HPF 22.

Further, the strip line electrode LL11 constitutes the transmission line LL1 of the LPF 21, and the strip line electrode LL21 constitutes the transmission line LL2 of the HPF 22.

As a result, the high-frequency component 20 having the circuit shown in FIG. 5 is constructed into a single multilayer substrate.

Figure 8:
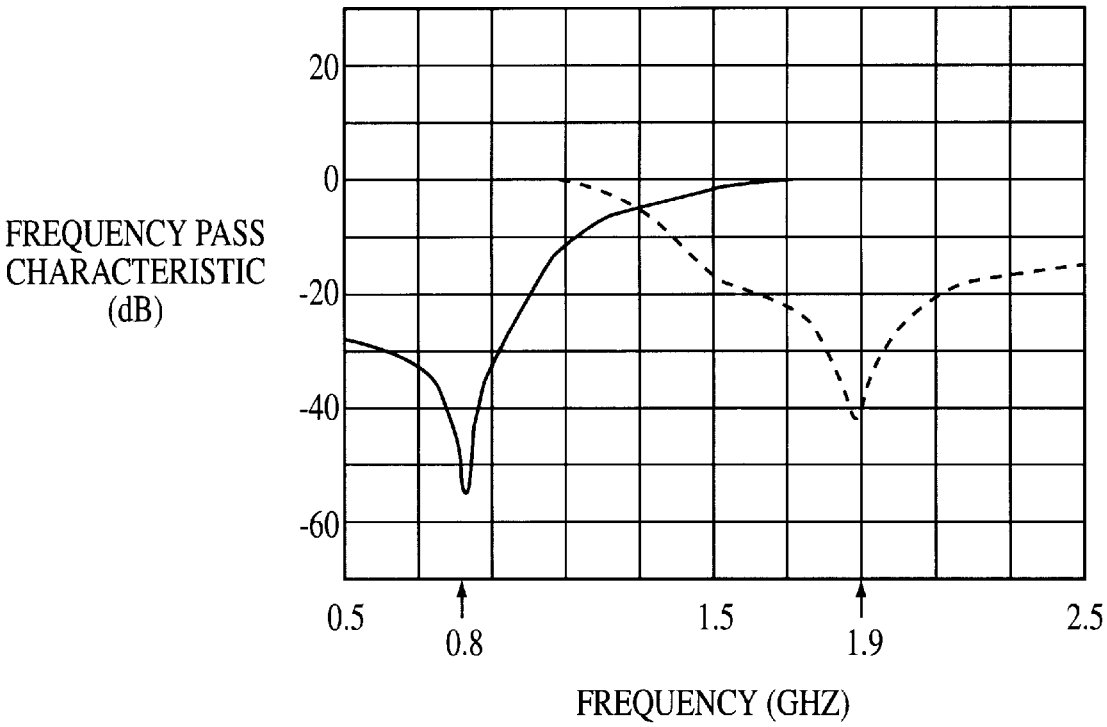
FIG. 8 is a graph showing frequency characteristics of a dual-band high-frequency component for 800 MHz and 1.9 GHz.
Figure 9:
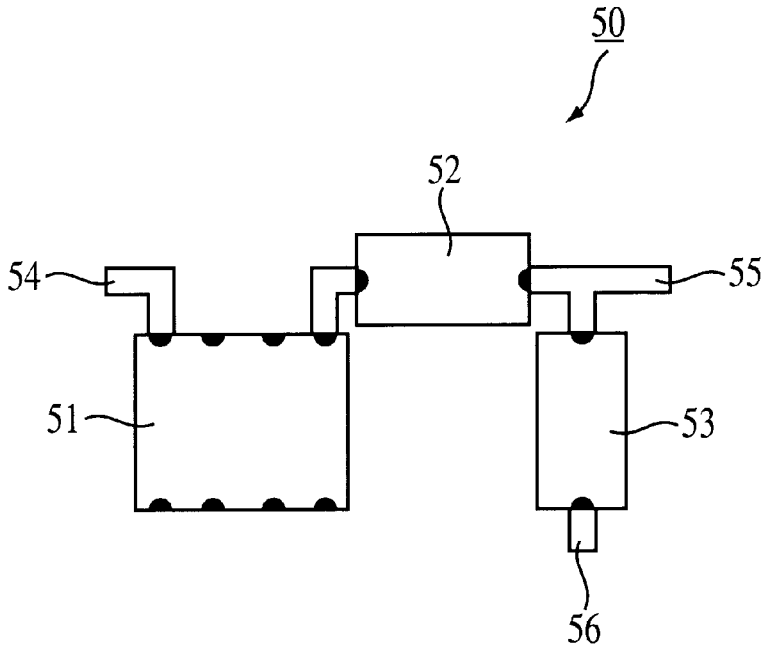
FIG. 9 PRIOR ART
FIG. 9 is an illustration showing one example of a conventional high-frequency component.
Figure 10:
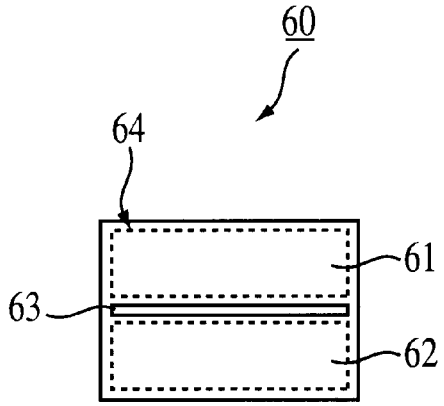
FIG. 10 PRIOR ART
FIG. 10 is an illustration showing the relationship in layout between a high-frequency filter and a low-frequency filter in another conventional high-frequency component.

Here, FIG. 8 shows the frequency dependency of the signal passing characteristics of the dual-band high-frequency component used in the AMPS system at 800 MHz and in the PCS system at 1.9 GHz as seen between the first port P1 and the second port P2 and between the first port P1 and the third port P3. In FIG. 8, a solid line represents the frequency passing characteristics that result between the first port P1 and the second port P2, and a broken line represents the frequency passing characteristics that result between the first port P1 and the third port P3.

As will be seen from FIG. 8, the high-frequency signal passing between the first port P1 and the second port P2 takes a level of substantially zero (dB) around 1.9 GHz, while the high-frequency signal passing between the first port P1 and the third port P3 takes a level of substantially zero (dB) around 800 MHz. This means that mutual interference between the LPF 21 and the HPF 22 is sufficiently suppressed without providing any shielding electrode.

With the high-frequency component of this second embodiment, as explained above, since it comprises the low pass filter connected between the first port and the second port and the high pass filter connected between the first port and the third port, the number of the transmission lines and the capacitors making up filter components can be reduced, in addition to the advantages of the first embodiment. It is thus possible to make the size of the high-frequency component smaller. Practically, all the elements can be built in a multilayer substrate having outline dimensions of 4.5 mm(L)×3.2 mm(W)×1.0 mm(H).

Also, mutual interference between the LPF and the HPF can be sufficiently suppressed without providing any shielding electrode.

Further, simplification of the manufacturing process can be realized, since the low pass filter and the high pass filter are made up of the strip line electrodes, capacitor electrodes and ground electrodes which are provided on the surfaces of a plurality of dielectric layers, as well as the viahole electrodes penetrating the respective dielectric layers for the appropriate connection of the strip line electrodes, capacitor electrodes and ground electrodes.

It should be understood that the equivalent circuit diagrams of the high-frequency components and the top and bottom plan views of the dielectric layers making up the high-frequency components which are shown in FIGS. 1 to 4 and FIGS. 5 to 7 and have been referred to for explaining the first and second embodiments are adopted merely by way of example. Any modifications of the high-frequency components are construed to be involved in the scope of the present invention so long as they are formed of transmission lines and capacitors built in a multilayer substrate.

Also, while a combination of plural LC filters has been described as the combination of a band pass filter and a band reject filter, or the combination of a low pass filter and a high pass filter, they may also be any other suitable combination, such as a combination of a band pass filter and a band pass filter, or a combination of a band reject filter and a band reject filter, for example. Of those combinations, particularly, in the combination of the low pass filter and the high pass filter and the combination of the band reject filter and the band reject filter, the number of transmission lines and capacitors can be reduced, resulting in an even smaller size of the high-frequency component.

In addition, while the transmission lines L1–L4, LL1 and LL2 have been described as being formed of strip lines, they may be formed of micro-strip lines, coplanar guide lines, etc.

According to the high-frequency component of the present invention, sets of filter components connected between the first port and the second port and between the first port and the third port are made up of only inductance elements and capacitance elements, and all the elements are built in a multilayer substrate. A reduction in size and cost of the high-frequency component can be therefore achieved.

Also, since the frequency pass ranges of at least two sets of filter components are selected not to overlap with each other, there is no need of providing a shielding electrode between the sets of filter components. It is thus possible to suppress interference between the sets of filter components and to easily achieve desired characteristics without providing any shielding electrode.

Further, since there is no need of providing a shielding electrode, the sets of filter components can be located freely in any desired place in the multilayer substrate without restrictions. For example, the sets of filter components can be formed side by side horizontally on the multilayer substrate.

Additionally, the sets of filter components are made up of strip line electrodes, capacitor electrodes and ground electrodes which are provided on the surfaces of a plurality of dielectric layers, as well as viahole electrodes penetrating the respective dielectric layers for appropriate connection of the strip line electrodes, capacitor electrodes and ground electrodes. As a result, simplification of the manufacturing process can be realized.

What is claimed is:

1. A high-frequency component comprising a multi layer substrate formed of a laminated plurality of dielectric layers, and at least two filters having respective substantially non-overlapping frequency pass bands, said at least two filters being formed of inductance elements and capacitance elements, said inductance and capacitance elements comprising electrodes formed on corresponding dielectric layers in said multilayer substrate;

at least two of said electrodes, each being in a respective one of said at least two filters, being disposed side-by-side on a single layer in said multilayer substrate with exclusively non-conductive material between them;

wherein each of said at least two electrodes constitutes an inductor which is one of said inductance elements and coacts with said capacitance elements to define said frequency pass bands.

2. A high-frequency component comprising a multilayer substrate formed of a laminated plurality of dielectric layers, and at least two filters having respective substantially non-overlapping frequency pass bands, said at least two filters being formed of inductance elements and capacitance elements, said inductance and capacitance elements comprising electrodes formed on corresponding dielectric layers in said multilayer substrate, wherein said at least two filters are made up of:

strip line electrodes provided on corresponding surfaces of at least one of said dielectric layers for constituting said inductance elements, at least two of said strip lines, each being in a respective one of said at least two filters, being disposed side-by-side on a single one of said layers with exclusively non-conductive material between them;

capacitor electrodes provided adjacent to corresponding surfaces of at least one of said dielectric layers for constituting said capacitance elements;

ground electrodes provided on corresponding surfaces of at least one of said dielectric layers; and viahole electrodes penetrating said dielectric layers and interconnecting respective ones of said strip line electrodes, said capacitor electrodes and said ground electrodes;

wherein each of said at least two strip lines constitutes an inductor which is one of said inductance elements and coacts with said capacitance elements to define said frequency pass bands.

3. The high-frequency component according to claim 1 or claim 2, wherein said at least two filters comprise a band pass filter and a band reject filter.

4. The high-frequency component according to claim 1 or claim 2, wherein said at least two filters comprise a high pass filter and a low pass filter.

5. The high-frequency component according to claim 1 or claim 2, wherein said at least two filters comprise at least one band pass filter.

6. The high-frequency component according to claim 1 or claim 2, wherein said at least two filters comprise at least one band reject filter.

* * * * *